US005507169A

United States Patent [19]

Cullen

[11] Patent Number: 5,507,169

[45] Date of Patent: Apr. 16, 1996

[54] THROW AWAY THREAD ROLLING DIE

[76] Inventor: William W. Cullen, 9241 Smith Ave., Baltimore, Md. 21234

[21] Appl. No.: 338,655

[22] Filed: Nov. 14, 1994

[51] Int. Cl.[6] ..... B21H 3/06

[52] U.S. Cl. ..... 72/469; 72/88; 76/107.1

[58] Field of Search ..... 72/88, 469, 379.2, 72/476; 76/107.1

[56] References Cited

U.S. PATENT DOCUMENTS

| | | | |
|---|---|---|---|
| 2,416,094 | 2/1947 | Gray | 72/379.2 |
| 3,327,569 | 6/1967 | Prutton | 76/107.1 |
| 3,558,409 | 1/1971 | Querreiro | 72/476 |
| 3,650,144 | 3/1972 | James | 76/107.1 |

*Primary Examiner*—Daniel C. Crane

[57] ABSTRACT

A throw away thread rolling die comprising a thin sheet of high carbon steel with the upper and lower surfaces in a rectangular configuration and with short parallel side edges and long parallel upper and lower edges, the length of the upper and lower edges being greater than the length of the side edges; a plurality of parallel grooves, corresponding in size and shape to the screw threads or any other configuration to be formed, shaped into the upper surface of the rectangular sheet, the rectangular sheet having a thickness which is greater than the depth of the grooves, the grooves being formed parallel or angular from a longitudinal center line parallel with and midpoint of the upper and lower edges; two trapezoidal and two rectangular side pieces formed integral with the upper, lower and side edges of the rectangular sheet, the side pieces being bent downwardly away from the upper surface at an obtuse angle to form a generally trapezoidal open box-like member; and a solid blank of a low carbon steel material, the blank having a trapezoidal shape with an upper and side surfaces to receive in contact therewith the lower surface of the sheet and the side pieces.

2 Claims, 3 Drawing Sheets

FIG. 1
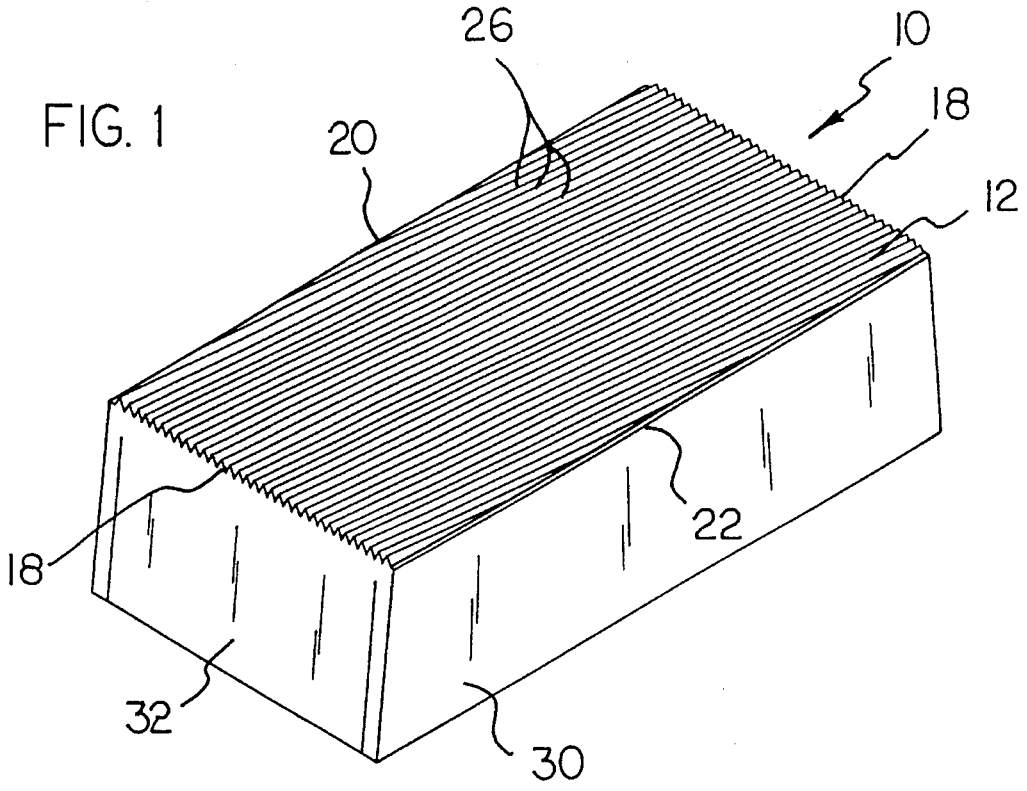
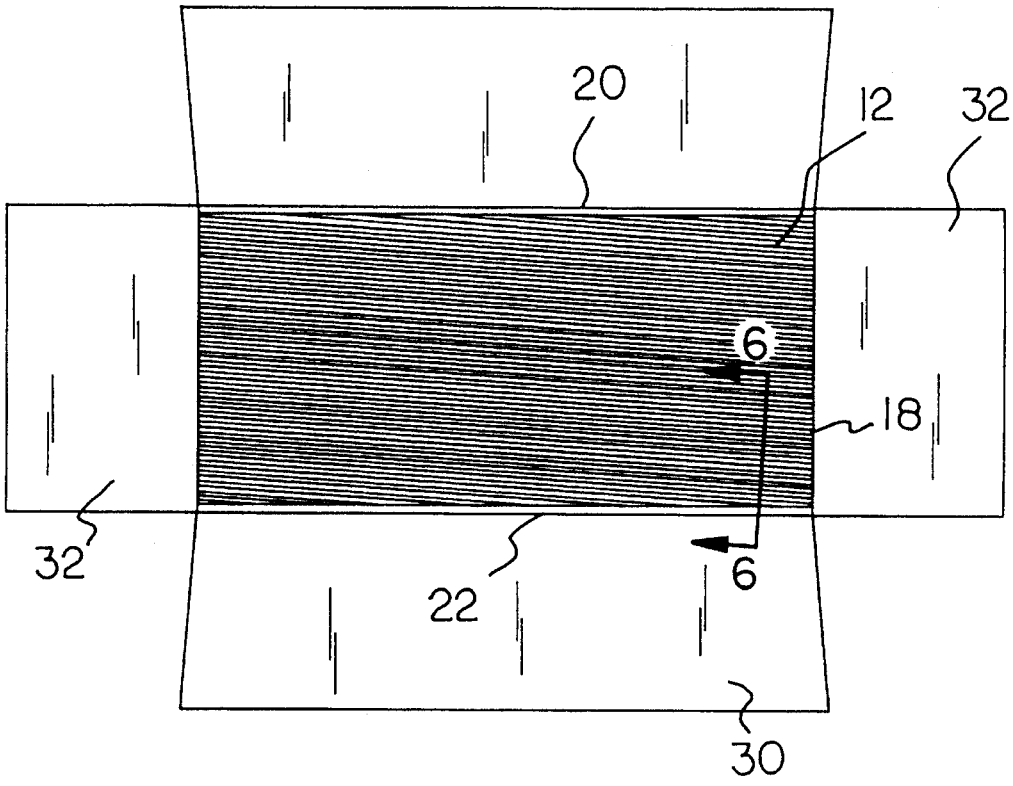
FIG. 2

FIG. 3
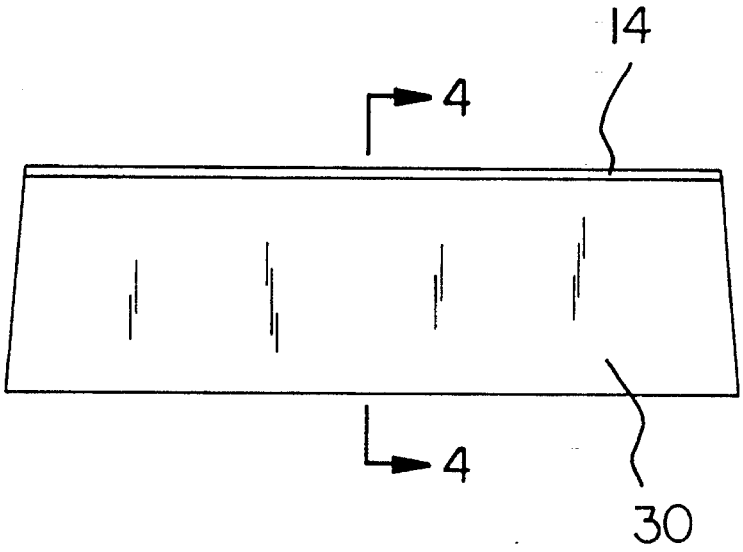
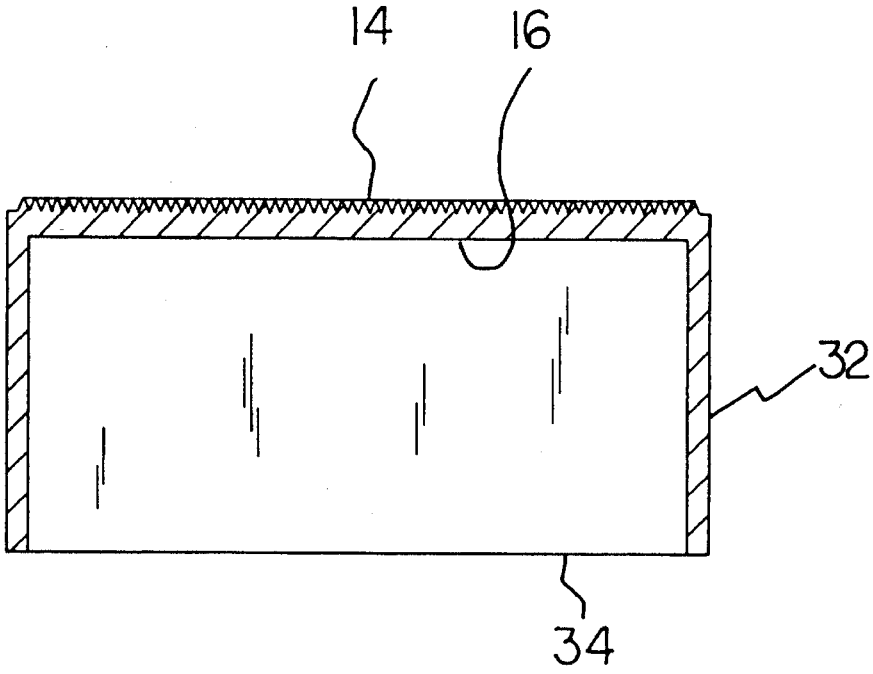
FIG. 4

FIG. 5
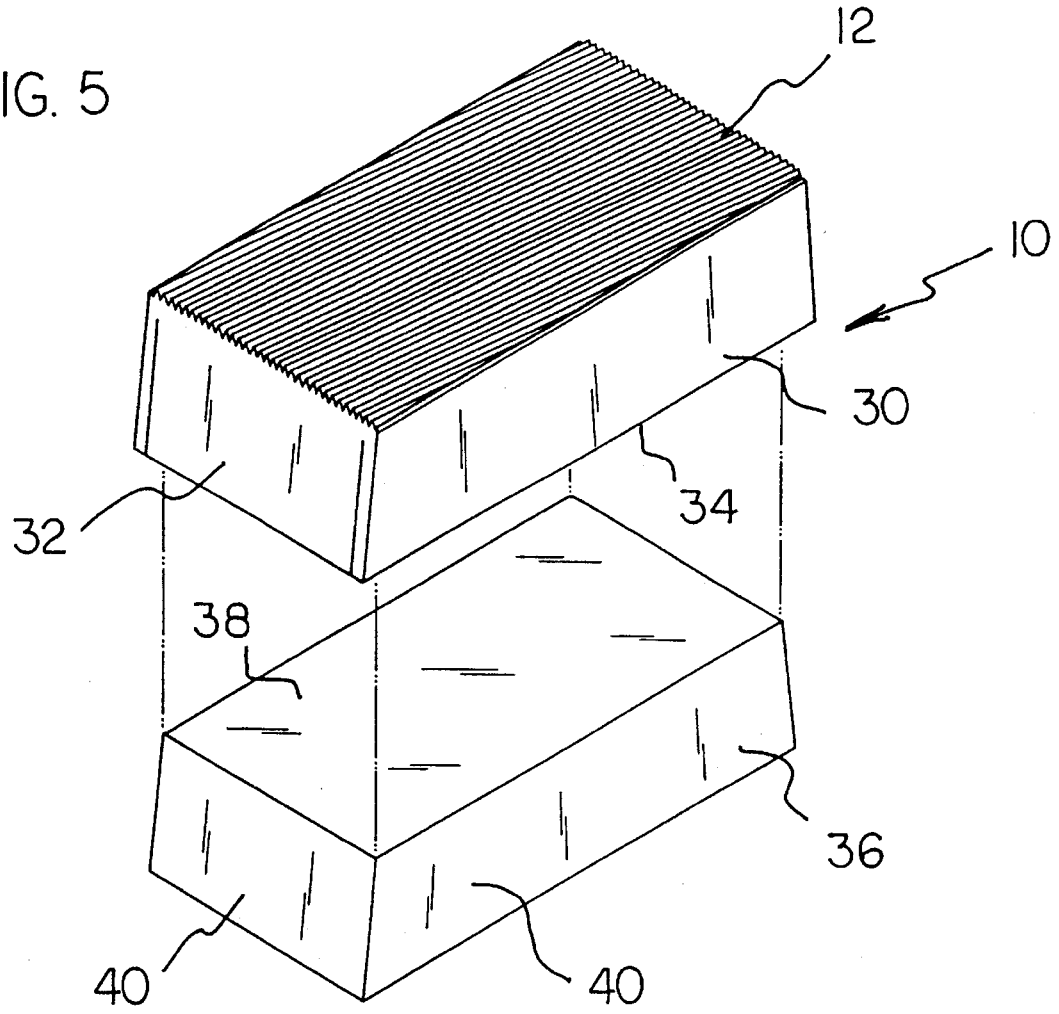
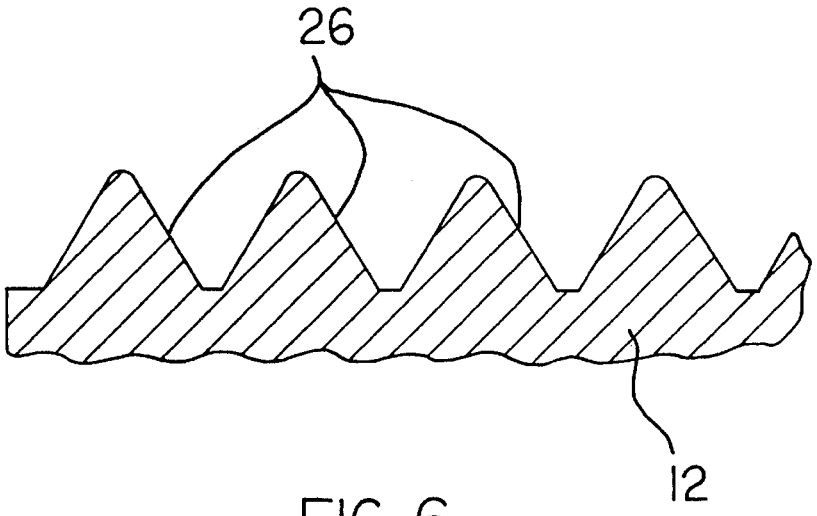
FIG. 6

THROW AWAY THREAD ROLLING DIE

BACKGROUND OF THE INVENTION

1. Field of the Invention

The present invention relates to a throw away thread rolling die and more particularly pertains to forming parallel or angular shapes in a thread rolling process wherein the die includes a thin cap of a hardened high speed carbon steel positionable over a blank of a softer, less expensive material.

2. Description of the Prior Art

The use of devices of various designs and constructions for forming threads on parts is known in the prior art. More specifically, devices of various designs and constructions for heretofore devised and utilized for the purpose of forming threads on parts employ large expensive rolling dies of various designs and constructions and are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 293,798 to Johnson discloses a tool for holding round thread die.

U.S. Pat. No. 4,096,722 to Torralba discloses a roll-type thread cutting die.

U.S. Pat. No. 4,862,718 to LaCroix discloses thread rolling dies.

U.S. Pat. No. 5,076,086 to Murayama et al discloses a thread rolling apparatus.

Lastly, U.S. Pat. No. 5,199,928 to Gress et al discloses a threading machine die head.

In this respect, the throw away thread rolling die according to the present invention substantially departs from the conventional concepts and designs of the prior art, and in doing so provides an apparatus primarily developed for the purpose of forming threads or any other configuration on parts by a thread rolling process wherein the die includes a thin cap of a high speed carbon steel positionable over a blank of a softer, less expensive material.

Therefore, it can be appreciated that there exists a continuing need for a new and improved throw away thread rolling die which can be used for forming threads or any other configuration on parts by a thread rolling process wherein a high speed carbon steel is positionable over a blank of a softer, less expensive material. In this regard, the present invention substantially fulfills this need.

SUMMARY OF THE INVENTION

In view of the foregoing disadvantages inherent in the known types of devices of various designs and constructions for forming threads or any other configuration on parts now present in the prior art, the present invention provides an improved throw away thread rolling die. As such, the general purpose of the present invention, which will be described subsequently in greater detail, is to provide a new and improved throw away thread rolling die and method which has all the advantages of the prior art and none of the disadvantages.

To attain this, the present invention essentially comprises a new and improved throw away thread rolling die comprising, in combination, a thin sheet of high carbon steel with the upper and lower surfaces in a rectangular configuration and with short parallel side edges and long parallel upper and lower edges, the length of the upper and lower edges being between about 1.5 and 2.5 times the length of the side edges; a plurality of parallel grooves, corresponding in size and shape to the screw threads or any other configuration to be formed, shaped into the upper surface of the rectangular sheet, the rectangular sheet having a thickness which is between about 2 and 5 times the depth of the grooves, the grooves being formed parallel or angular from a longitudinal center line parallel with and midpoint of the upper and lower edges; two trapezoidal and two rectangular side pieces formed integral with the upper, lower and side edges of the rectangular sheet, the side pieces being bent downwardly away from the upper surface at an obtuse angle to form a generally trapezoidal open box-like member; and a solid blank of a low carbon steel material, the blank having a trapezoidal shape with an upper and side surfaces to receive in contact therewith the lower surface of the sheet and the side pieces.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved throw away thread rolling die which has all the advantages of the prior art devices of various designs and constructions for forming grooves of any configuration on parts and none of the disadvantages.

It is another object of the present invention to provide a new and improved throw away thread rolling die which may be easily and efficiently manufactured and marketed.

It is further object of the present invention to provide a new and improved throw away thread rolling die which is of a durable and reliable construction.

An even further object of the present invention is to provide a new and improved throw away thread rolling die which is susceptible of a low cost of manufacture with regard to both materials and labor, and which accordingly is then susceptible of low prices of sale to the consuming public, thereby making such throw away thread rolling die economically available to the buying public.

Still yet another object of the present invention is to provide a new and improved throw away thread rolling die which provides in the apparatuses and methods of the prior art some of the advantages thereof, while simultaneously overcoming some of the disadvantages normally associated therewith.

Even still another object of the present invention is for from threads or any other configuration on parts by a thread rolling process wherein the die includes a cap of a high speed carbon steel positionable over a blank of a softer, less extensive material.

Lastly, it is an object of the present invention to provide a new and improved throw away thread rolling die comprising a thin sheet of high carbon steel with the upper and lower surfaces in a rectangular configuration and with short parallel side edges and long parallel upper and lower edges, the length of the upper and lower edges being greater than the length of the side edges; a plurality of parallel grooves, corresponding in size and shape to the screw threads or any other configuration to be formed, shaped into the upper surface of the rectangular sheet, the rectangular sheet having a thickness which is greater than the depth of the grooves, the grooves being formed parallel or angular from a longitudinal center line parallel with and midpoint of the upper and lower edges; two trapezoidal and two rectangular side pieces formed integral with the upper, lower and side edges of the rectangular sheet, the side pieces being bent downwardly away from the upper surface at an obtuse angle to form a generally trapezoidal open box-like member; and a solid blank of a material softer than the sheet, the blank having a trapezoidal shape with an upper and side surfaces to receive in contact therewith the lower surface of the sheet and the side pieces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the throw away thread rolling die constructed in accordance with the principles of the present invention.

FIG. 2 is a developed view of the device of FIG. 1 prior to placing into its final shape.

FIG. 3 is a side elevational view of the device of the prior Figures.

FIG. 4 is a cross-sectional view of the device taken along line 4—4 of FIG. 3.

FIG. 5 is an exploded perspective view of the cap of the prior Figures positionable on a backing blank.

FIG. 6 is an enlarged cross-sectional view of the threads formed on the upper exterior surface of the cap taken along line 6—6 of FIG. 2. These parallel threads formed on the upper exterior surface may take many different configurations as long as they lend themselves to good rolling tooling.

The same reference numerals refer to the same parts through the various Figures.

DESCRIPTION OF THE PREFERRED EMBODIMENT

With reference now to the drawings, and in particular to FIG. 1 thereof, the preferred embodiment of the new and improved throw away thread rolling die embodying the principles and concepts of the present invention and generally designated by the reference numeral 10 will be described.

The present invention, the new and improved throw away thread rolling die is comprised of a plurality of components. Such components in their broadest context include a thin sheet of high carbon steel, a plurality of parallel grooves, two trapezoidal and two rectangular side pieces and a solid blank. Such components are individually configured and correlated with respect to each other so as to attain the desired objective.

More specifically, the system 10 of the present invention has as its central component a thin sheet 12 of high carbon steel. The sheet has an upper surface 14 and a lower surface 16 parallel therewith. The sheet and its surfaces are in a rectangular configuration. They have short parallel side edges 18 and long parallel upper and lower edges 20 and 22.

A plurality of parallel grooves 26 are formed into the upper surface of the rectangular sheet. Such grooves correspond in size and shape to the screw threads or any other configuration to be formed. The rectangular sheet has a thickness which is between about two to five times the depth of the grooves.

The grooves are formed parallel or angular with respect to a longitudinal center line. Such center line is parallel with and at the midpoint of the upper and lower edges.

Next provided are four side pieces. Such side pieces include two large trapezoidal side pieces 30 formed integral with the upper and lower edges. In addition, two small rectangular side pieces 32 are formed integral with the side edges. Such rectangular side pieces may have equal sides and form squares or they may have unequal sides. The side pieces are bent downwardly from the plane of the upper surface to form obtuse angles. Together with the sheet they will create a generally trapezoidal box-like member with an opening 34 at its larger lower edges.

The last component of the system is a separately formed solid blank 36. The blank is formed of a low carbon steel material. The blank has a trapezoidal shape. Such shape includes an upper surface 38 and side surfaces 40 to receive in contact therewith the lower surfaces of the sheet and side pieces. When coupled together, the sheet with its side pieces in combination with the blank form a system for forming threads or any other configuration on a cylindrical stock wherein the expensive thread forming grooves are of a reduced cost as compared with known devices to constitute a throw away capability.

Screw threads or any other configuration are placed on external diameters of parts by several processes. They can be produced by the cutting action of sharp tools or grinding wheels which remove metal to obtain the spiral projections, or they can be formed. The forming method involves the displacement of metal to from the projections. Rather than cutting deeply into the metal, the material forming the bottom of the thread groove is rolled out of position and squeezed up to produce the shape of the threads. Most threads have a V-profile, but they can also be made with a square shape or with a variety of other profiles. The forming process is more commonly referred to as thread rolling.

Thread rolling involves preparing a blank by machining the outside diameter to the basic size known as the pitch diameter. At that diameter, the depth of the groove forming the thread is equal to the height of the thread which projects above it. Consequently, when the blank is rotated and fed into a tool which has two flat dies arranged opposite and parallel to the rotating center, the material is reshaped between the flat dies to form a thread shape. This process produces threads which are much stronger because of the cold working action and have smoother surfaces for easier engagement with the female threads.

Flat thread rolling dies are made in sets of two to four to fit into adjustable jaws on thread rolling machines. They are made of expensive tool steels and are heat treated to a high hardness and ground. The cost for the finished dies is unbelievably high because they are designed to produce many pieces. However, for short run applications, the expense is prohibitive.

The present invention replaces expensive solid flat dies used in flat thread rolling machines. The present invention employs inexpensive low carbon steel blanks. Positioned over the blanks are thin caps od high carbon steel which have appropriate shapes in the contact surfaces. The shapes are provided in the thin caps, made of high speed steel sheet that fit over the blanks. They are held in place by their shape and clamps which are part of the thread rolling machine. When the run is completed or they have become worn or distorted, the inexpensive caps are simply thrown away.

A key feature of the present invention is that the cap with the different configuration of grooves, which actually roll the different type threads, must be hardened the same as dies being used today. The difference is the thin sheet is easier to heat treat and fabricate making the part less expensive to produce.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved throw away thread rolling die comprising, in combination:

a thin sheet of hardened high speed carbon steel with the upper and lower surfaces in a rectangular configuration and with short parallel side edges and long parallel upper and lower edges;

a plurality of parallel grooves, corresponding in size and shape to the screw threads, shaped into the upper surface of the rectangular sheet, the rectangular sheet having a thickness which is between about two and five times the depth of the grooves, the grooves being formed parallel or angular from a longitudinal center line parallel with and midpoint of the upper and lower edges;

two trapezoidal and two rectangular side pieces formed integral with the upper, lower and side edges of the rectangular sheet, the side pieces being bent downwardly away from the upper surface at an obtuse angle to form a generally trapezoidal open box-like member; and a solid blank of a low carbon steel material, softer than the sheet, the blank having a trapezoidal shape with an upper and side surfaces to receive in contact therewith the lower surface of the sheet and the side pieces.

2. A throw away thread rolling die comprising:

a thin sheet of hardened high carbon steel with the upper and lower surfaces in a rectangular configuration and with short parallel side edges and long parallel upper and lower edges, the length of the upper and lower edges being greater than the length of the side edges;

a plurality of parallel grooves, corresponding in size and shape to the screw threads, shaped into the upper surface of the rectangular sheet, the rectangular sheet having a thickness which is greater than the depth of the grooves, the grooves being formed parallel or angular from a longitudinal center line parallel with and midpoint of the upper and lower edges;

two trapezoidal and two rectangular side pieces formed integral with the upper, lower and side edges of the rectangular sheet, the side pieces being bent downwardly away from the upper surface at an obtuse angle to form a generally trapezoidal open box-like member; and a solid blank of a low carbon steel material, the blank having a trapezoidal shape with an upper and side surfaces to receive in contact therewith the lower surface of the sheet and the side pieces.

* * * * *